US006513662B1

(12) United States Patent
Stebelton

(10) Patent No.: US 6,513,662 B1
(45) Date of Patent: Feb. 4, 2003

(54) VARIABLE PROFILE CORNER POST

(75) Inventor: Gregory S. Stebelton, Madison, TN (US)

(73) Assignee: Sonoco Development, Inc., Hartsville, SC (US)

( * ) Notice: Subject to any disclaimer, the term of this patent is extended or adjusted under 35 U.S.C. 154(b) by 30 days.

(21) Appl. No.: 09/683,039

(22) Filed: Nov. 12, 2001

(51) Int. Cl.[7] ..... B65D 81/05
(52) U.S. Cl. ..... 206/586
(58) Field of Search ..... 206/305, 320, 206/453, 586; 229/199; 493/299, 311

(56) References Cited

U.S. PATENT DOCUMENTS 3,221,973 A * 12/1965 Kalbrener ..... 206/586
3,344,916 A * 10/1967 Brueckner ..... 206/453
3,648,920 A 3/1972 Stump
3,708,101 A * 1/1973 McDanield ..... 206/586
3,854,579 A 12/1974 Scharre
3,957,196 A * 5/1976 Kellerman ..... 206/586
4,248,350 A * 2/1981 Gilbert ..... 206/586
4,399,915 A * 8/1983 Sorenson ..... 206/586
4,482,054 A 11/1984 Gardner
4,483,444 A 11/1984 Gardner
4,848,581 A 7/1989 Besore et al.
5,133,459 A 7/1992 Genix
5,267,651 A 12/1993 Hughes
5,593,039 A 1/1997 Ortlieb
5,813,537 A 9/1998 DeReu et al.
6,059,104 A 5/2000 Widman
6,186,329 B1 2/2001 Qiu
6,234,314 B1 * 5/2001 Qiu et al. ..... 206/586

* cited by examiner

*Primary Examiner*—Jim Foster
(74) *Attorney, Agent, or Firm*—Bullwinkel Partners, Ltd.

(57) ABSTRACT

A laminated paper corner post for protecting a packaged article, the corner post having a variable cross-sectional profile in the axial direction.

6 Claims, 4 Drawing Sheets

VARIABLE PROFILE CORNER POST

BACKGROUND OF INVENTION

This patent relates to a tubular corner post of the type used to cushion and protect a packaged article, such as a desk or appliance. More particularly, this patent relates to a tubular laminated paper corner post that has a variable cross-sectional profile along its height to accommodate irregularities in the shape of the packaged article.

Conventional corner posts are made by applying adhesive to paper, winding the wet paper around a mandrel and cutting the wound paper to a desired length to form one or more cylindrical tubes having a substantially circular cross-section, sliding the wound paper tubes onto a forming tool while the tubes are still malleable, forming the tubes into a desired shape, and allowing the adhesive between the paper layers to set up to form the finished tubes. Although conventional tubular corner posts may be cut to any length, they all have a uniform cross-sectional profile.

Many examples of conventional laminated corner posts are known in the art. For example, Gardner U.S. Pat. No. 4,482,054 discloses a laminated paper corner post having longitudinally-extending beads that provide improved resistance to longitudinally directed compression forces and enhanced cushioning against laterally directed forces. The corner post has a constant cross-sectional profile.

Gardner U.S. Pat. No. 4,483,444 discloses a corner post having a cross-sectional profile that accommodates overhang of the post relative to a bottom board without substantially reducing the resistance of the post to compressive forces. The cross-sectional profile is constant along the height of the post.

Hughes U.S. Pat. No. 5,267,651 discloses a corner post having laterally directed stiffening beads extending at an acute angle into free engagement with the opposite wall. When subjected to sufficient lateral force, the beads collapse onto themselves, forming intermediate layers between the inner and outer walls.

Qiu et al. U.S. Pat. No. 6,186,329 discloses a laminated corner post made from multiple sheets of paper. Like all the prior art corner posts described above, the Qiu corner post has a constant cross-sectional profile.

While each of these prior art corner posts is useful for its particular purpose, none has a variable cross-sectional profile to accommodate irregularities in the contours of the article being protected.

Thus it is an object of the present invention to provide a laminated paper corner post having a variable cross-sectional profile that can better accommodate the irregular contours of packaged articles.

Further and additional objects will appear from the detailed description, accompanying drawings, and appended claims.

SUMMARY OF INVENTION

The present invention is a new style of laminated paper corner post in which the cross-sectional profile varies along the length of the post. This variability improves the protective and cushioning properties of the post by allowing the post to mate better with certain features of the product being protected, such as trim lips, fragile contact points, protruding knobs, screw heads, etc.

Like conventional corner posts, the variable profile corner post is made by winding adhesive coated paper around a mandrel to form a cylindrical tube having a substantially circular cross-section, then sliding the still-wet tube onto a forming tool to form the desired shape. However, unlike conventional corner post manufacture, the forming tool has a variable cross-sectional profile, so that when the outer forming elements press the paper tube against the forming tool, the resulting corner post also has a variable cross-sectional profile.

In the preferred embodiment, the variable profile corner post has a lower section having a constant cross-sectional profile, an upper section having a different cross-sectional profile, and a middle section interposed between the first and second sections where the post transitions from one cross-sectional profile to the other cross-sectional profile. Because the variable profile corner post starts out as a cylindrical tube having a constant cross-section, the finished variable profile corner post has a constant circumference along its length.

DETAILED DESCRIPTION

Figure 1:
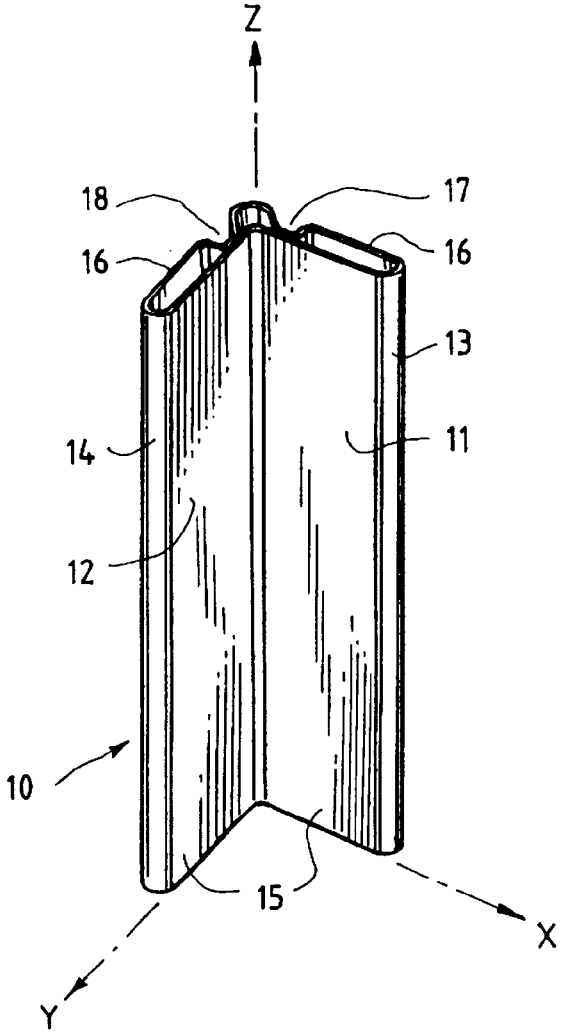
FIG. 1 PRIOR ART
FIG. 1 is a top perspective view of a prior art corner post.
Figure 2:
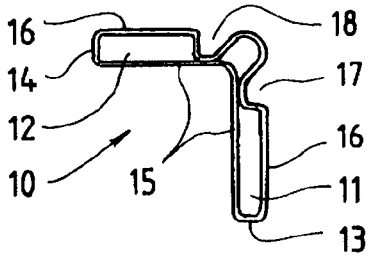
FIG. 2 PRIOR ART
FIG. 2 is a top plan view of the prior art corner post of FIG. 1.
Figure 3:
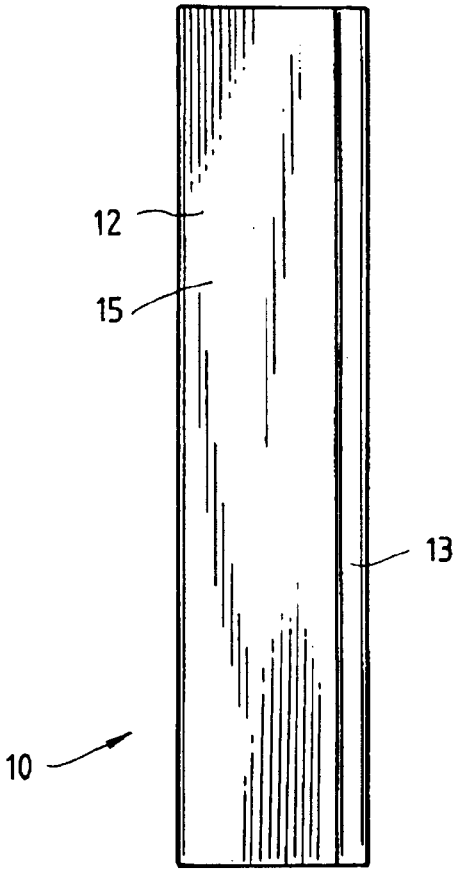
FIG. 3 PRIOR ART
FIG. 3 is a side elevational view of the prior art corner post of FIG. 1.
Figure 4:
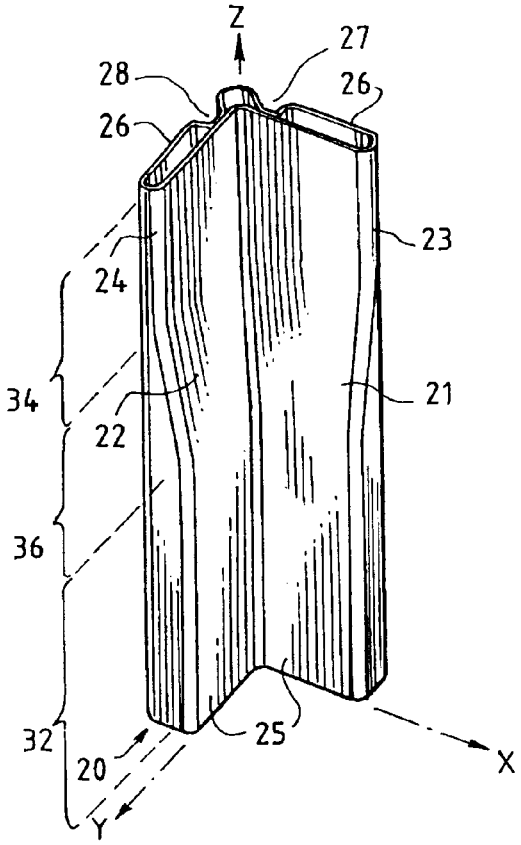
FIG. 4 is a top perspective view of a first embodiment of the variable profile corner post of the present invention.
Figure 5:
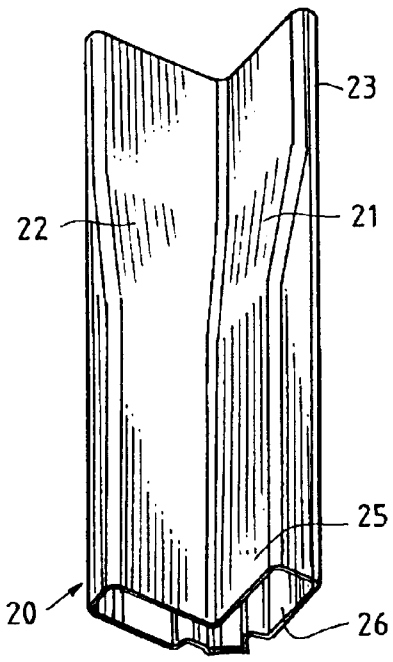
FIG. 5 is a bottom perspective view of the corner post of FIG. 4.
Figure 6:
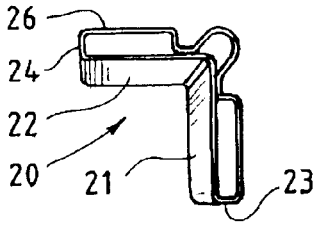
FIG. 6 is a top plan view of the corner post of FIG. 4.
Figure 7:
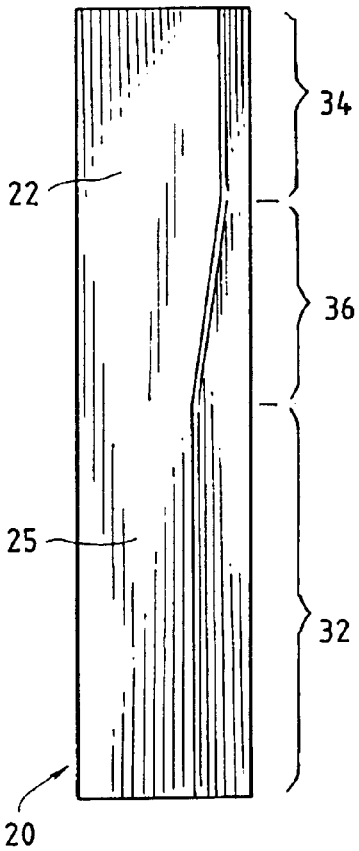
FIG. 7 is a side elevational view of the corner post of FIG. 4.
Figure 8:
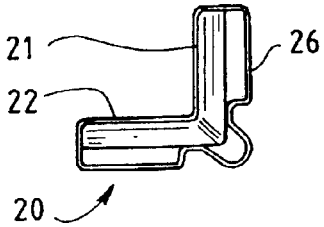
FIG. 8 is a bottom plan view of the corner post of FIG. 4.
Figure 9:
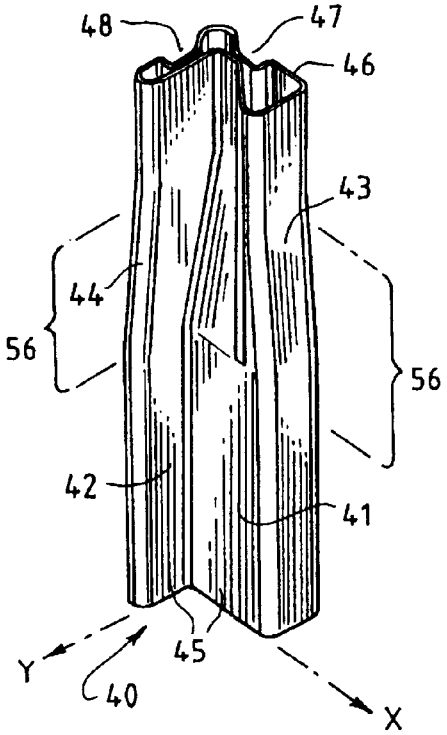
FIG. 9 is a top perspective view of a second embodiment of the variable profile corner post of the present invention.
Figure 12:
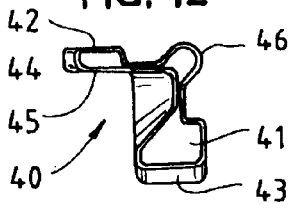
FIG. 12 is a top plan view of the corner post of FIG. 9.
Figure 13:
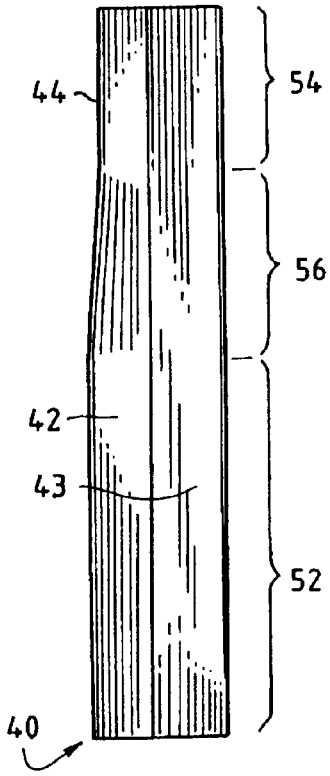
FIG. 13 is a right side view of the corner post of FIG. 9.
Figure 10:
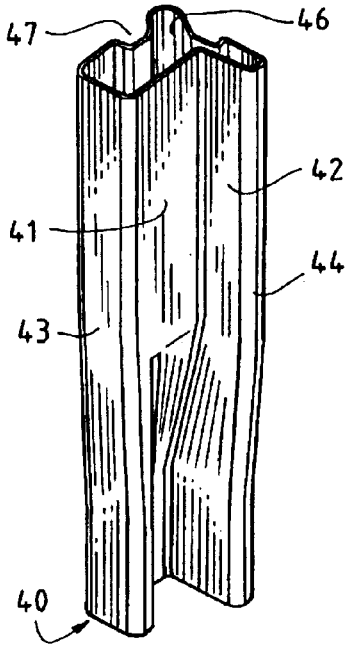
FIG. 10 is a bottom perspective view of the corner post of FIG. 9, shown in an inverted position.
Figure 14:
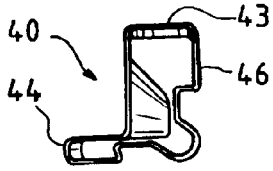
FIG. 14 is a bottom plan view of the corner post of FIG. 9.
Figure 11:
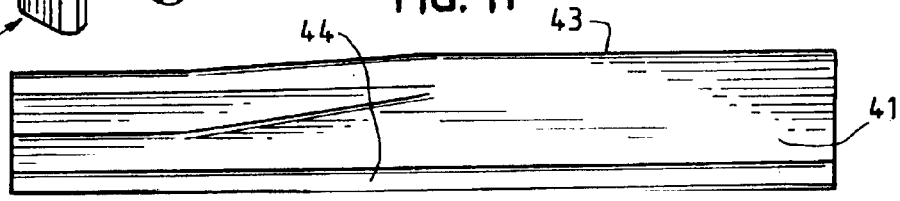
FIG. 11 is a left side view of the corner post of FIG. 9.
Figure 15:
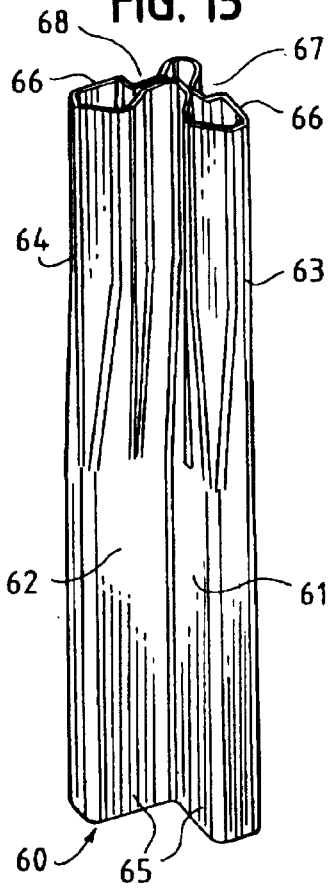
FIG. 15 is a top perspective view of a third embodiment of the variable profile corner post of the present invention.
Figure 17:
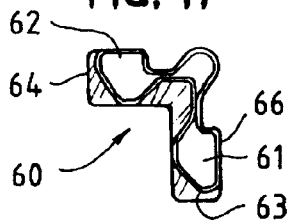
FIG. 17 is a top plan view of the corner post of FIG. 15.
Figure 18:
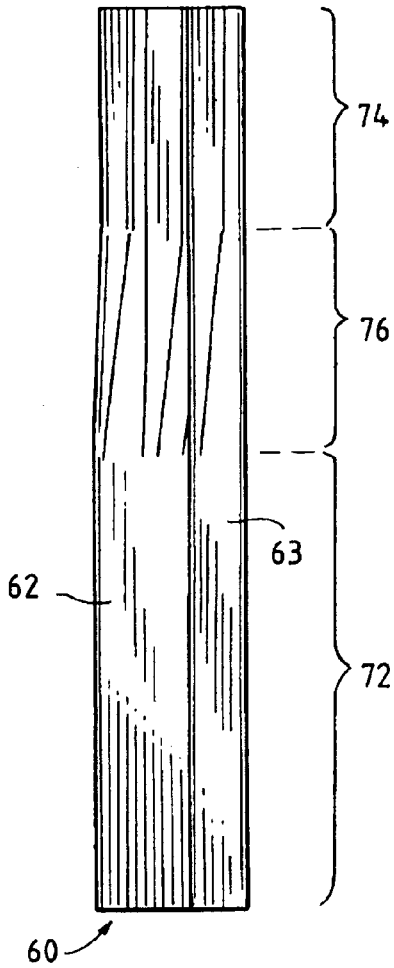
FIG. 18 is a side view of the corner post of FIG. 15.
Figure 16:
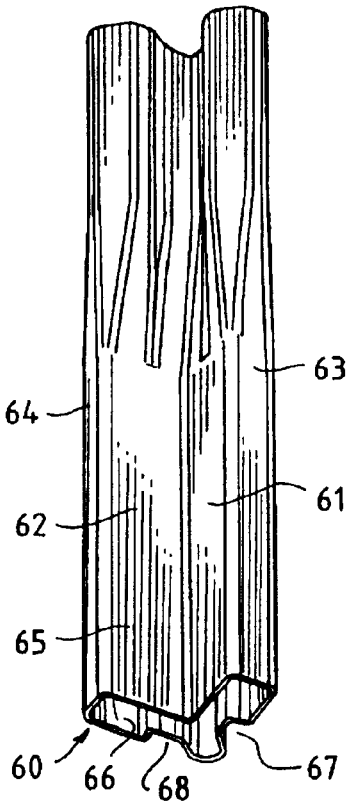
FIG. 16 is a bottom perspective view of the corner post of FIG. 15.
Figure 19:
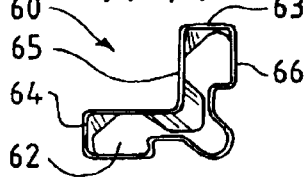
FIG. 19 is a bottom plan view of the corner post of FIG. 15.

Turning to the drawings, a prior art corner post is shown in FIGS. 1–3. The corner post is made by applying wet adhesive to paper, winding the wet paper around a mandrel having a substantially circular cross-section, cutting the wound paper to a desired length to form one or more cylindrical tubes having a substantially circular cross-section, sliding the wound paper tubes onto a forming tool while the tubes are still malleable, forming the tubes into the shape shown in FIGS. 1–3, and allowing the adhesive between the paper layers to set up to form the finished tubes. The finished corner posts are usually placed at each corner of an article between the article and the inside corners of the package. The corner posts protect the article against vertical (axial) and horizontal (lateral) forces.

The conventional corner post 10 of FIGS. 1–3 comprises two legs 11, 12 substantially perpendicular to each other that terminate in integrally formed ends 13, 14. The legs 11, 12 are defined by an inner wall 15 (the wall nearest the article) and an outer wall 16 in generally parallel spaced relation to each other. Inwardly directed beads 17, 18 are formed in the outer wall 16 along each leg 11, 12 and extend the entire vertical length of the corner post 10. The beads enhance the resistance of the corner post to vertical forces.

As shown in the FIG. 1, the finished corner post has a constant cross-sectional profile throughout its length (height). That is, the post has two-dimensional variability only (variability in the x-y plane).

By contrast, the present invention is a paper corner post having three-dimensional variability, including variability along its length (height). This variability improves the protective and cushioning properties of the post by allowing the post to mate better with certain features of the product being protected, such as trim lips, fragile contact points, protruding knobs, screw heads, etc.

FIGS. 4–8 illustrate a first embodiment of a variable profile corner post according to the present invention. Like the prior art corner post 10, the variable profile corner post 20 comprises two legs 21, 22 substantially perpendicular to each other that terminate in integrally formed ends 23, 24. The legs 21, 22 are defined by an inner wall 25 and an outer wall 26 in generally parallel spaced relation to each other. Inwardly directed beads 27, 28 are formed in the outer wall 26 along each leg 21, 22, and extend the entire axial length of the corner post 20. It will be appreciated that the variable profile corner post can have beads formed in the inner wall 25, both walls, or have no beads at all.

The corner post 20 comprises a lower section 32 having a constant profile when viewed in cross-section taken transverse to the longitudinal axis of the post (i.e. a constant cross-sectional profile), an upper section 34 having a cross-sectional profile that is constant yet different from the lower section 32, and a middle or transition section 36 interposed between the lower and upper sections where the post 20 transitions from one cross-sectional profile to the other cross-sectional profile.

The variability in the cross-sectional profile of the corner post 20 in the axial direction is a result of the variable cross-sectional profile of the inner wall 25, since the outer wall 26 preferably has a constant cross-sectional profile. This three-dimensional variability allows the post to work in situations where two-dimensional variability is inadequate to mate with the article being protected.

For example, in the corner post of FIGS. 4–8, the portion of the inner wall 25 that forms the lower section 32 is vertical; the shape of the inner wall 25 does not vary within the x-y plane as the height (z coordinate) changes. However, the portion of the inner wall 25 that forms the middle section 36 is not perfectly vertical; its profile changes within the x-y plane as the height changes. This is the transition section of the post. Moving further up the corner post, the portion of the corner post that forms the upper section 34 is vertical, but it occupies a different orientation within the x-y plane than the portion of the inner wall 25 that forms the lower section 32.

Like conventional corner posts, the variable profile corner post is made by first winding adhesive-coated paper around a mandrel to form a cylindrical tube having a substantially circular—and constant—cross-section, sliding the tube onto a forming tool to form the tube into the desired shape, then cooling the tube to set the adhesive. Unlike conventional (constant profile) corner post manufacture, the forming tool has a variable cross-section along at least a portion of its length. In order for the corner post to be able to slide off the forming tool, the cross-section of the forming tool must constrict (get smaller) toward the end where the corner post slides off, which is the top of the post in the figures. This is perhaps most apparent in FIGS. 6 and 8, where it can be seen that the corner post profile at the top fits within the profile at the bottom of the corner post.

Because the variable profile corner post is formed from a cylindrical tube initially having a constant cross-sectional profile, and because the paper used to make the corner post is not stretched, shrunk, torn or folded over on itself, the finished variable profile corner post has a constant circumference (i.e., the distance around the periphery of any cross-section). FIGS. 9–14 illustrate a second embodiment of the variable profile corner post of the present invention. Like the prior art corner post 10 and the first embodiment 20, the second embodiment 40 comprises two legs 41, 22 substantially perpendicular to each other that terminate in integrally formed ends 43, 44. The legs 41, 42 are defined by an inner wall 45 and an outer wall 46 in generally spaced relation to each other. Optional inwardly directed beads 47, 48 are formed in the outer wall 46 along each leg 41, 42, and extend the entire axial length of the corner post 40.

As in the first embodiment 20, the corner post 40 comprises a lower section 52 having a constant cross-sectional profile, an upper section 54 having a cross-sectional profile that is constant yet different from the lower section 52, and a middle or transition section 56 interposed between the lower and upper sections where the post 40 transitions from one cross-sectional profile to the other cross-sectional profile.

Unlike the first embodiment, the legs are not symmetrical. Instead, leg 41 is wider at its end 43 than is leg 42. Also, the middle portion 56 of the inner wall 45 of leg 41 is not vertical (it varies within the x-y plane as the height changes). Furthermore, the ends 43, 44 are not vertical. Instead, they taper inward toward the top of the corner post 40. In other words, the horizontal lengths of the legs 41, 42 change.

FIGS. 15–19 illustrate a third embodiment of the variable profile corner post of the present invention. Like the previously described corner posts, the third embodiment 60 comprises two legs 61, 62 substantially perpendicular to each other that terminate in integrally formed ends 63, 64. The legs 61, 62 are defined by an inner wall 65 and an outer wall 66 in generally spaced relation to each other. Optional inwardly directed beads 67, 68 are formed in the outer wall 66 along each leg 61, 62, and extend the entire axial length of the corner post 60.

As in the first two embodiments 20, 40, the corner post 60 comprises a lower section 72 having a constant cross-sectional profile, an upper section 74 having a cross-sectional profile that is constant yet different from the lower section 72, and a middle or transition section 76 interposed between the lower and upper sections where the post 60 transitions from one cross-sectional profile to the other cross-sectional profile. Like the first embodiment 20, the legs are the same shape.

In all three embodiments, the variable cross-sectional profile of the inner wall is intended to accommodate outwardly protruding features of the product being protected, such as trim lips, handles, knobs, and screw heads. The outer wall, on the other hand, typically abuts two flat, perpendicular sides of a rectilinear package, and therefore need not have a variable cross-sectional profile.

Other modifications and alternative embodiments of the invention are contemplated which do not depart from the scope of the invention as defined by the foregoing teachings and appended claims. It is intended that the claims cover all such modifications that fall within their scope.

What is claimed is:

1. An elongated corner post for protecting a packaged article, the corner post comprising paper wound around a mandrel to form multiple, adjacent, substantially flat layers adhered together with adhesive, the length of the corner post defining an axis, the corner post having a variable cross-sectional profile in the axial direction, wherein the cross-sectional profile transitions from one cross-sectional profile to another along a curvilinear transitional area.

2. The corner post of claim 1 wherein the transitional area is continuous.

3. The corner post of claim 1 wherein the transitional area is interposed between sections having a constant cross-sectional profile.

4. The corner post of claim 1, wherein the corner post comprises two legs oriented substantially perpendicular to each other, each leg terminating in a vertical end, the legs being defined by an outer wall and an inner wall in generally parallel spaced relation to each other and joined at their respective ends to form the vertical ends of the legs, the inner wall being the wall facing the packaged article.

5. The corner post of claim 4 wherein the outer wall has a constant cross-sectional profile and the inner wall has a variable cross-sectional profile.

6. The corner post of claim 1 wherein the corner post has a constant horizontal circumference.

* * * * *